US009570867B2

(12) United States Patent
Geniac et al.

(10) Patent No.: US 9,570,867 B2
(45) **Date of Patent: *Feb. 14, 2017**

(54) NOTCHED CONTACT FOR A MODULAR PLUG

(71) Applicants: CommScope Technologies LLC, Hickory, NC (US); CommScope Connectivity Spain, S.L., Alcobendas, Madrid (ES)

(72) Inventors: Joseph Edward Geniac, Greensboro, NC (US); William Joseph Peteritas, Kernersville, NC (US); Mark William Neff, Kernersville, NC (US); Longinos de Dios, Cerdanyola del Valles (ES)

(73) Assignee: CommScope Technology LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/004,115

(22) Filed: Jan. 22, 2016

(65) Prior Publication Data

US 2016/0261081 A1 Sep. 8, 2016

Related U.S. Application Data

(63) Continuation of application No. 14/198,906, filed on Mar. 6, 2014, now Pat. No. 9,246,265.

(Continued)

(51) Int. Cl.
*H01R 4/24* (2006.01)
*H01R 24/64* (2011.01)

(Continued)

(52) U.S. Cl.
CPC ..... *H01R 24/64* (2013.01); *H01R 4/2404* (2013.01); *H01R 4/2425* (2013.01); *H01R 13/26* (2013.01);

(Continued)

(58) Field of Classification Search
CPC ..... H01R 13/627; H01R 24/64; H01R 24/62; H01R 4/2433; H01R 4/2404; H01R 4/2429

See application file for complete search history.

(56) References Cited

U.S. PATENT DOCUMENTS 4,650,269 A 3/1987 Denkmann et al.
4,715,825 A 12/1987 Mouissie et al.

(Continued)

*Primary Examiner* — Xuong Chung Trans
(74) *Attorney, Agent, or Firm* — Merchant & Gould P.C.

(57) ABSTRACT

A metallic contact for insertion into a modular telecommunications plug includes a generally planar body defining a top end, a bottom end, a front end, a rear end, and a length extending from the front end to the rear end. The bottom end is at least partially defined by a blade for piercing an insulation of a wire positioned within the plug. At least a portion of the top end is configured to electrically contact a conductor of a jack that receives the plug. The top end is defined at least in part by a first engagement surface that is separated from a second engagement surface by a notch. An uppermost portion of the first engagement surface defines a first push surface that is generally at the same height as a second push surface defined by an uppermost portion of the second engagement surface. The notch is defined by a front vertical wall spaced from a rear vertical wall, wherein the front vertical wall is positioned at a distance of at least half the length of the contact from the front end of the contact.

14 Claims, 2 Drawing Sheets

Related U.S. Application Data

(60) Provisional application No. 61/778,035, filed on Mar. 12, 2013.

(51) Int. Cl.

| | |
|---|---|
| ***H01R 13/26*** | (2006.01) |
| ***H01R 13/627*** | (2006.01) |
| ***H01R 43/16*** | (2006.01) |
| *H01R 43/20* | (2006.01) |
| *H01R 107/00* | (2006.01) |

(52) U.S. Cl.

CPC ..... *H01R 13/627* (2013.01); *H01R 13/6272* (2013.01); *H01R 43/16* (2013.01); *H01R 43/20* (2013.01); *H01R 2107/00* (2013.01); *H01R 2201/04* (2013.01)

(56) References Cited

U.S. PATENT DOCUMENTS

| | | | | |
|---|---|---|---|---|
| 4,950,176 | A | 8/1990 | Cocco et al. | |
| 5,041,010 | A | 8/1991 | Collier | |
| 5,071,365 | A | 12/1991 | Fremgen et al. | |
| 5,186,649 | A | 2/1993 | Fortner et al. | |
| 5,556,296 | A | 9/1996 | Dussausse et al. | |
| 5,727,967 | A | 3/1998 | Chen | |
| 6,017,240 | A | 1/2000 | Belopolsky et al. | |
| 6,116,943 | A | 9/2000 | Ferrill et al. | |
| 6,149,454 | A | 11/2000 | Watanabe | |
| 6,227,899 | B1 | 5/2001 | Bogese, II | |
| 6,270,372 | B1 | 8/2001 | Jenner et al. | |
| 6,276,954 | B1 | 8/2001 | Arnett et al. | |
| 6,402,559 | B1 | 6/2002 | Marowsky et al. | |
| 6,866,536 | B1 | 3/2005 | Lee | |
| 6,991,488 | B2 | 1/2006 | Freakes | |
| 7,156,687 | B1 | 1/2007 | Chiang et al. | |
| 8,025,522 | B2 | 9/2011 | Freakes | |
| 9,246,265 | B2 * | 1/2016 | Geniac ..... | H01R 13/627 |
| 2009/0176415 | A1 | 7/2009 | AbuGhazaleh et al. | |

* cited by examiner

NOTCHED CONTACT FOR A MODULAR PLUG

CROSS-REFERENCE TO RELATED APPLICATION

This is a continuation of U.S. patent application Ser. No. 14/198,906, filed Mar. 6, 2014, now U.S. Pat. No. 9,246,265, which claims the benefit of U.S. Provisional Patent Application Ser. No. 61/778,035, filed Mar. 12, 2013, which applications are hereby incorporated by reference in their entirety.

FIELD

The present disclosure relates generally to telecommunications devices. In particular, the present disclosure relates to the metallic contacts of a modular plug.

BACKGROUND

Telecommunications cables such as electrical cables are typically connected to jacks using modular plugs. The cables are normally comprised of a number of insulated wire pairs surrounded by a cable jacket. Cable assemblies may be constructed by securing modular plugs to the ends of the cable wires. Then a plug is slid into a matching cavity of a jack and secured therein with a snap-fit interlock, normally involving a flexible lever-like latch. The modular plug is inserted into the jack cavity to establish electrical connection between the cable wires terminated to the plug and conductive elements in the jack. A registered jack (e.g., RJ45) type modular plug is one example of a plug that can be used in constructing such cable assemblies.

Typically, a modular plug includes a polymeric housing that defines a front termination end and a rear end that has a cable receiving opening. Adjacent the front end within the housing are troughs, which are configured to receive the wires of a cable that has been inserted through the opening. Slots are provided adjacent the front termination end. The slots communicate with the troughs and are configured for receiving metallic contacts in a direction perpendicular to the troughs. The metallic contacts of the plug, once received in the slots, establish electrical communication with the cable wires that are in the troughs. The slots are open at the top of the plug housing, opposite the troughs, and are also open at the front end of the housing.

In terminating a cable to a modular plug, the jacket of the cable is stripped from an end portion of the cable. The stripped portion is inserted through the rear opening of the plug housing with the cable wires received into the troughs. The cable is then fixed with respect to the plug and the plug is positioned on an apparatus that is used for inserting the contacts into the plug housing. Once the metallic contacts are seated within the slots, an apparatus that includes an actuated ram applies a downward force in moving and causing the seated contacts to engage the wires that are within the troughs.

According to other methods, the contacts may also be partially pre-inserted into the plug housing prior to the insertion of the cable wires and then fully crimped down thereafter.

Each metal contact normally defines blades that are configured to pierce the insulation of a wire at a first end of the contact. The opposite second end of the metal contact normally defines a flat surface that is configured to be engaged by the ram for driving the contact into the plug housing. When the contacts are fully inserted into the plug housing, the blades of the contacts pierce the insulation and engage the wires of the cable to provide an electrical connection.

When each metal contact is fully inserted into the plug housing and engaged with the wires, a portion of the contact is positioned within the plug housing and not exposed to the exterior of the housing and a portion of the contact (e.g., a portion that includes the second end) is exposed to an exterior of the plug housing. The exposed portion of the contact resides within the slot but communicates with the exterior of the plug housing due to the slot opening at the top and the slot opening at the front of the plug housing.

When the plug is inserted into a jack cavity, the exposed portions of the contacts within the slots are adapted to engage corresponding conductors within the jack cavity and complete the electrical connection from the wires of the cable to the jack.

The second end of the plug contact that includes the flat surface (used for engagement with the ram) normally also defines rounded surfaces adjacent both the front and the rear of the contact. The contact is normally symmetrical with respect to an axis which extends through its center of gravity and which is normal to the flat surface of the second end. The rounded shape of the surfaces adjacent the front and the rear functions to engage an aligned conductor of a jack into which the plug is inserted. As known, each of the conductors of the jack may extend angularly within the jack cavity and may engage only a portion of the metal contact of the plug (e.g., the rounded front surface).

In manufacturing such contacts for insertion into modular plugs, substantially the entire surface area of the contact is covered with one or more layers of metallic material by a process such as electroplating. One type of metallic material that might be used is nickel, which provides corrosion resistance, smooths out the rough contact material, and prevents diffusion of the contact metal into subsequently deposited layers of other types of metallic material. The nickel layer may then be covered with a relatively thin layer of a precious metal (e.g., gold, palladium nickel, etc.), which enhances connection with the cable wires.

In addition, other selected surface areas of the contact are also covered with an additional layer of the precious metal to enhance the conductivity of the connection with a conductor of the jack. The selected portions may include the rounded surfaces of the second end because they are exposed surfaces and are normally engaged by an aligned jack conductor. The exposed flat surface between the rounded surfaces at the front and rear is also normally covered since this surface might also come into contact with the jack conductors. When providing the additional layer of the precious metal for enhanced conductivity, a relatively small portion of each flat side surface of the contact might also be covered due to the plating process.

Cost savings may be realized by reducing the areas of a contact which are covered with the precious metal (such as gold or palladium nickel), particularly in view of the large number of plugs which are manufactured each year. Improved designs of contacts which might provide for such cost savings without sacrificing performance and/or manufacturability are desired.

SUMMARY

The present disclosure relates generally to a new contact design for a modular plug that is configured to provide cost savings by reducing the area of the portions of the contact that must be covered by a precious metal.

According to one particular aspect, the present disclosure relates to a metallic contact for insertion into a modular plug, wherein the contact includes a generally planar body defining a top end, a bottom end, a front end, a rear end, and a length extending from the front end to the rear end. The bottom end is at least partially defined by a blade for piercing an insulation of a wire positioned within the plug. At least a portion of the top end is configured to electrically contact a conductor of a jack that receives the plug. The top end is defined at least in part by a first engagement surface that is separated from a second engagement surface by a notch. An uppermost portion of the first engagement surface defines a first push surface that is generally at the same height as a second push surface defined by an uppermost portion of the second engagement surface. The notch is defined by a front vertical wall spaced from a rear vertical wall, wherein the front vertical wall is positioned at a distance of at least half the length of the contact from the front end of the contact.

According to another aspect, the present disclosure relates to a modular telecommunications plug for connection to a jack, the modular telecommunications plug including a housing defining a latch for snap-fit engagement with the jack, the housing further defining a front termination end and a rear cable receiving end, the front termination end configured to house a plurality of wires of a telecommunications cable to be inserted into the housing from the rear cable receiving end along a cable insertion direction, the front termination end also including a plurality of contacts configured to engage the plurality of wires in a direction generally perpendicular to the cable insertion direction. Each of the plurality of contacts includes a generally planar body defining a top end, a bottom end, a front end, a rear end, and a length extending from the front end to the rear end, wherein the bottom end is at least partially defined by a blade for piercing an insulation of a wire positioned within the plug and at least a portion of the top end is configured to electrically contact a conductor of a jack that receives the modular telecommunications plug. The top end is defined at least in part by a first engagement surface that is separated from a second engagement surface by a notch, wherein an uppermost portion of the first engagement surface defines a first push surface that is generally at the same height as a second push surface defined by an uppermost portion of the second engagement surface. The notch is defined by a front vertical wall spaced from a rear vertical wall, wherein the front vertical wall defining the notch is positioned at a distance of at least half the length of the contact from the front end of the contact.

According to another aspect, the present disclosure relates to a telecommunications cable assembly including a modular telecommunications plug for connection to a jack, the modular telecommunications plug comprising a housing defining a latch for snap-fit engagement with the jack and a telecommunications cable defining a cable jacket surrounding a plurality of insulated wires coupled to the housing, wherein a plurality of contacts of the modular telecommunications plug engage the wires of the telecommunications cable coupled to the housing. Each of the plurality of contacts includes a generally planar body defining a top end, a bottom end, a front end, a rear end, and a length extending from the front end to the rear end, wherein the bottom end is at least partially defined by a blade for piercing an insulation of a wire coupled to the plug and at least a portion of the top end is configured to electrically contact a conductor of a jack that receives the modular telecommunications plug. The top end is defined at least in part by a first engagement surface that is separated from a second engagement surface by a notch, wherein an uppermost portion of the first engagement surface defines a first push surface that is generally at the same height as a second push surface defined by an uppermost portion of the second engagement surface. The notch is defined by a front vertical wall spaced from a rear vertical wall, wherein the front vertical wall defining the notch is positioned at a distance of at least half the length of the contact from the front end of the contact.

According to another aspect, the present disclosure relates to a method of manufacturing a contact for a modular plug comprising stamping a contact from a planar metallic sheet, wherein the contact includes a body defining a top end, a bottom end, a front end, a rear end, and a length extending from the front end to the rear end, wherein the bottom end is configured to at least partially define a blade for piercing an insulation of a wire and the top end is defined at least in part by a first engagement surface that is separated from a second engagement surface by a notch, wherein an uppermost portion of the first engagement surface defines a first push surface that is generally at the same height as a second push surface defined by an uppermost portion of the second engagement surface, the notch being defined by a front vertical wall spaced from a rear vertical wall, wherein the front vertical wall defining the notch is positioned at a distance of at least half the length of the contact from the front end of the contact and coating at least a portion of the top end of the contact with a precious metal.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Reference will now be made in detail to examples of inventive aspects of the present disclosure which are illustrated in the accompanying drawings. Wherever possible, the same reference numbers will be used throughout the drawings to refer to the same or like parts.

Figure 1:
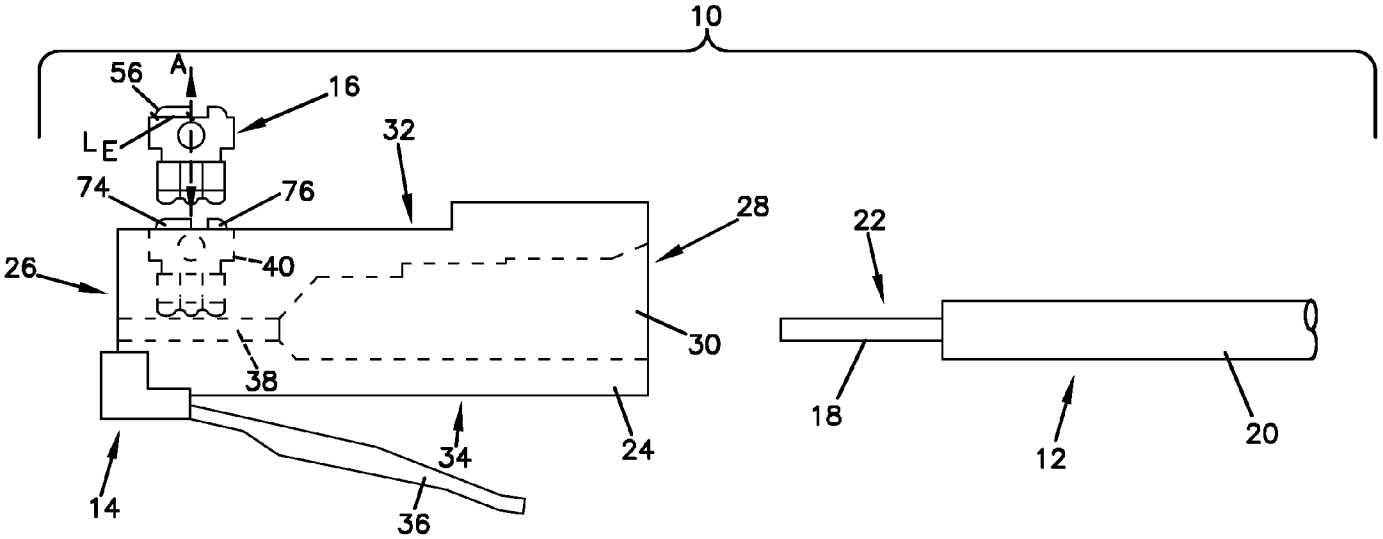
FIG. 1 is a partially exploded side view of a cable assembly including a stripped telecommunications cable and a modular plug configured for terminating the cable, wherein the modular plug includes a plurality of contacts having features that are examples of inventive aspects in accordance with the principles of the present disclosure.
Figure 2:
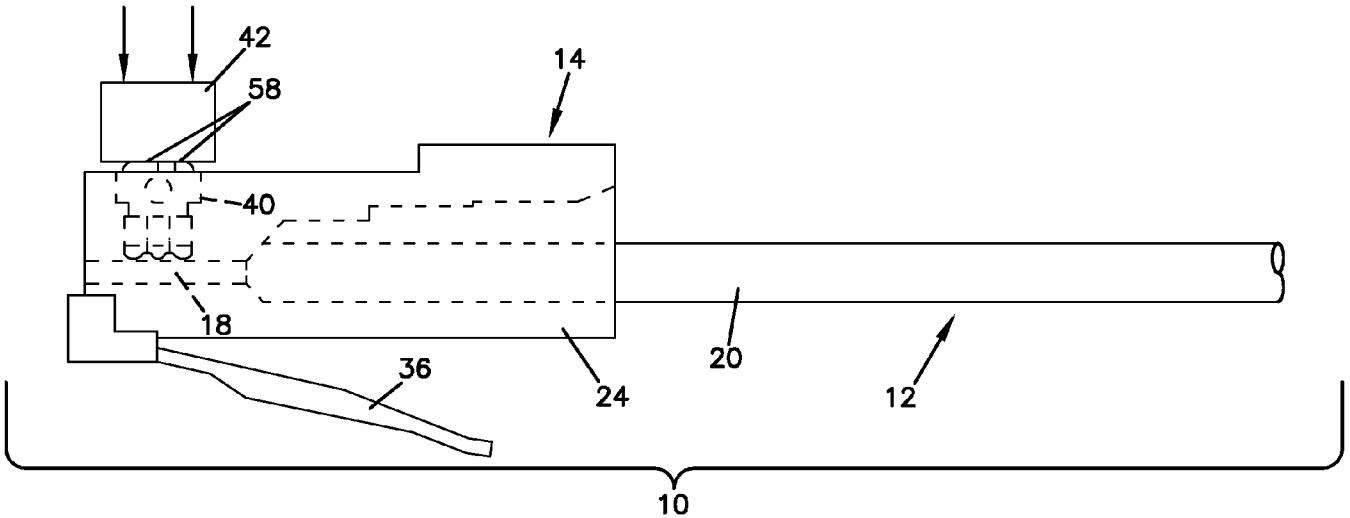
FIG. 2 illustrates the use of an apparatus including an actuated ram for inserting the contacts into the modular plug of the cable assembly of FIG. 1.
Figure 3:
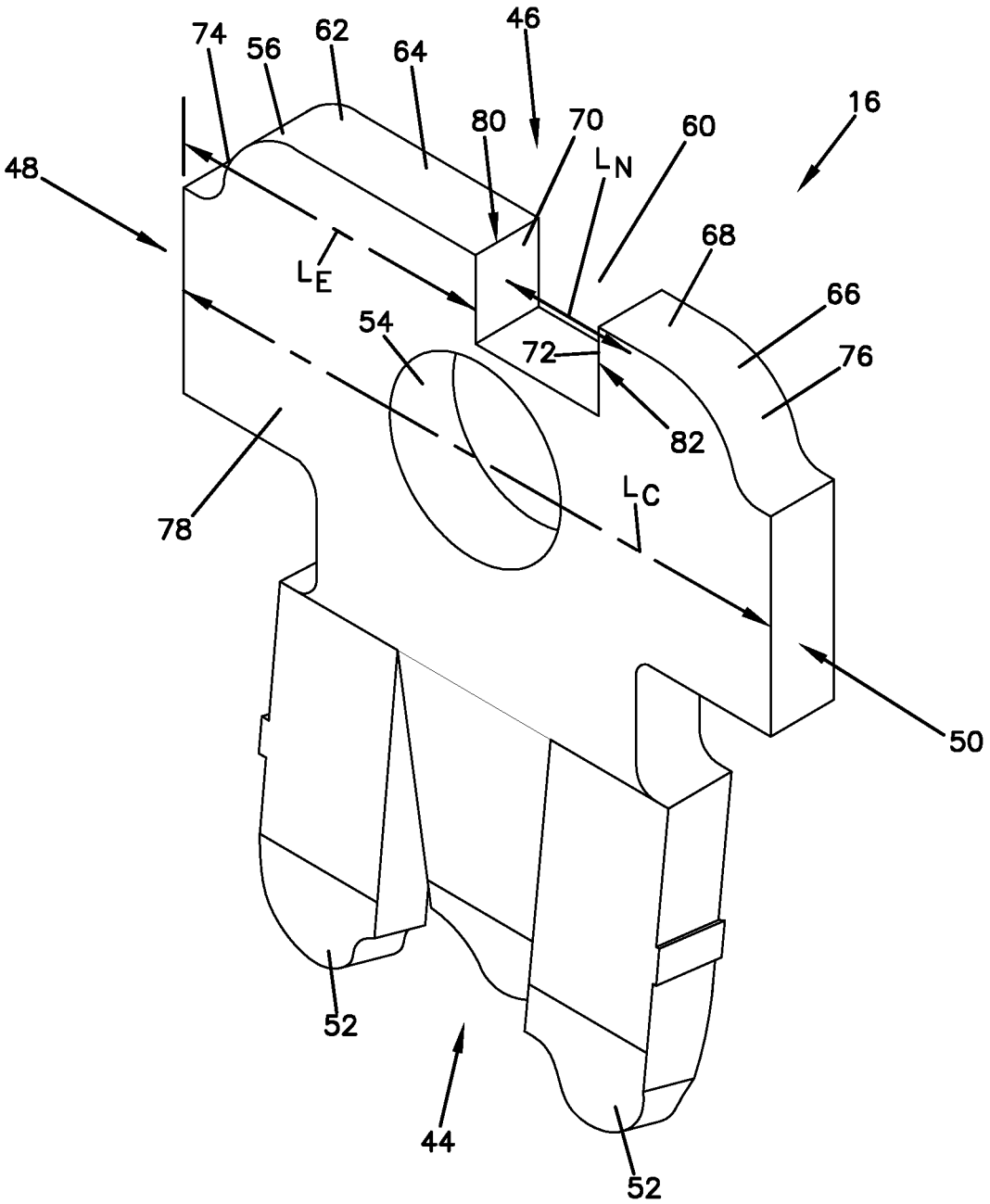
FIG. 3 is a perspective view of one of the contacts of the modular plug of FIGS. 1 and 2, the contact having features that are examples of inventive aspects in accordance with the principles of the present disclosure.

Referring now to FIGS. 1-3, a cable assembly 10 is illustrated. The cable assembly 10 includes a telecommunications cable 12 and a modular plug 14 configured for terminating the telecommunications cable 12, wherein the modular plug 14 includes plurality of metallic contacts 16 having features that are examples of inventive aspects in accordance with the principles of the present disclosure. One of the contacts 16 having features that are examples of inventive aspects in accordance with the principles of the present disclosure is illustrated in isolation in FIG. 3.

Still referring to FIGS. 1-3, the cable 12 depicted is an electrical cable and includes a plurality of insulated wire pairs 18 surrounded by a cable jacket 20. When the cable 12 is to be terminated to the modular plug 14, the jacket 20 of the cable 12 is stripped from an end portion 22 of the cable 12 to expose the wires 18.

The modular plug 14 of the cable assembly 10 is the portion that is configured to be terminated to the electrical cable 12 and inserted into a jack cavity to establish an electrical connection between the cable wires 18 and conductive elements within the jack cavity.

The modular plug 14 of the cable assembly 10, according to the present disclosure, is a registered jack (e.g., RJ45) type modular plug. Other types of telecommunications plugs are certainly usable with the contacts 16 having features that are examples of inventive aspects in accordance with the principles of the present disclosure.

The modular plug 14 defines a plug housing 24, normally manufactured from a polymeric or dielectric material. The housing 24 defines a front termination end 26 and a rear end 28 that has a cable receiving opening 30. The housing 24 further defines a top side 32 and a bottom side 34, with a flexible latch 36 extending at an acute angle rearwardly from the bottom side 34. As is known in the art, the flexible latch 36 is configured for selectively locking the modular plug 14 into a jack cavity with a snap-fit interlock.

Adjacent the front end 26 are defined a number of troughs 38 that extend partially within the plug housing 24 in a longitudinal direction. The troughs 38 are configured to receive the wires 18 of the cable 12 once the cable 12 is inserted through the rear opening 30.

The plug housing 24 also defines slots 40 that communicate with the troughs 38. The slots 40 are configured for receiving contacts 16 of the plug 14 in a direction perpendicular to the troughs 38. The contacts 16, once received in the slots 40, establish electrical communication with the cable wires 18 that are within the troughs 38. The slots 40 are open at the top side 32 of the plug housing 24, opposite the troughs 38, and are also open at the front end 26 of the plug housing 24.

When terminating the cable 12 to the modular plug 14, the contacts 16 are seated within the slots 40. An apparatus that includes an actuated ram 42 (as shown diagrammatically in FIG. 2) applies a downward force in moving and causing the seated contacts 16 to engage the wires 18 of the cable 12 that have been inserted into the troughs 38.

Referring now to the contact 16 having features that are examples of inventive aspects in accordance with the principles of the present disclosure shown in isolation in FIG. 3, the contact 16 defines a bottom first end 44 and a top second end 46. The contact 16 also defines a front end 48 and a rear end 50. The contact 16 includes blade portions 52 that extend in a direction from the top end 46 toward the bottom end 44. The blades 52 are configured to pierce the insulation of a wire 18 that is within one of the troughs 38 to establish electrical contact with the conductors of the wire 18. Even though the embodiment of the contact 16 depicted includes three blades 52, the contacts 16 may be manufactured to include different numbers (such as two) and types of blades, depending upon the type of conductor of the wire.

During manufacturing, since the contacts 16 may initially be stamped out of a flat metallic sheet, each contact 16 may also define a locating hole 54 for positioning during the stamping process used to stamp the contacts 16.

Now referring to FIGS. 2-3, when a metal contact 16 is fully inserted into the plug housing 24 and engaged with a wire 18, a portion of the contact 16 is positioned within the plug housing 24 and is not configured to be exposed to the exterior of the housing 24. A portion of the contact 16 (e.g., a portion that includes the top second end 46) is exposed to an exterior of the plug housing 24 via the slots 40. The exposed portion of the contact 16 is configured to reside within a slot 40 but communicate with the exterior of the plug housing 24 due to the slot having openings at the top side 32 and the front end 26 of the plug housing 24. When the plug 14 is inserted into a jack cavity, the exposed portions of the contacts 16 within the slots 40 are adapted to engage corresponding conductors within a jack cavity and complete the electrical connection from the wires 18 of the cable 12 to the jack.

The top second end 46 of the metal contact 16, a portion of which is configured to make electrical contact with a conductor of a jack, defines an engagement surface 56. At least a portion of the engagement surface 56 is a push surface 58 that is configured to interact with the ram 42 when the ram 42 applies a downward force in fully inserting the contact 16 into the plug housing 24. In the depicted embodiment, the push surface 58 defines a flat push surface. In other embodiments, the push surface 58 may define other configurations.

The top second end 46 of the metal contact 16 also defines a notch 60 positioned between the front and the rear ends 48, 50 of the contact 16. The notch 60 divides the engagement surface 56 of the contact 16 into a first engagement surface 62 which includes a first push surface 64 (e.g., a flat surface) and a second engagement surface 66 which includes a second push surface 68 (e.g., a flat surface). The first and second push surfaces 64, 68 are depicted as flat surfaces and are generally at the same vertical height on the contact 16.

According to one example embodiment, the notch 60 is partially defined by a first vertical wall 70 that starts at least halfway going from the front end 48 of the contact 16 to the rear end 50 of the contact 16. The rear of the notch 60 is defined by a second vertical wall 72. In the depicted embodiment, the first and second push surfaces 64, 68 are generally perpendicular to the first and second vertical walls 70, 72 defining the notch 60.

Still referring to FIG. 3, at the top second end 46 of the contact 16, a portion of the engagement surface 56 is defined by a rounded surface 74 adjacent the front end 48 and a rounded surface 76 adjacent the rear end 50 of the contact 16. The rounded surfaces 74, 76 provide a transition from the front and rear ends 48, 50 of the contact 16 to the first and second flat push surfaces 64, 68, respectively. Each of the conductors of a jack may extend angularly within a jack cavity and may engage only a portion of the engagement surface 56 of the metal contact 16 (e.g., the rounded surface 74). The rounded surface 74 functions to provide a smooth path for a jack conductor that is contacting the second end 46 of the metallic contact 16.

As shown in FIGS. 1-3, except for the notch 60, the contact 16 is normally symmetrical with respect to an axis A which extends through its center of gravity and which is normal to the flat push surface 58 defined by the second end 46.

As discussed previously, in manufacturing such modular plug contacts 16, substantially the entire surface area of the contact 16 is normally covered with a layer of metallic material, such as nickel, by a process such as electroplating.

The nickel layer is then normally covered with a relatively thin layer of a precious metal (e.g., gold, palladium nickel, etc.), which enhances the connection with the cable wires 18. In addition, other selected surface areas of the contact 16 are also covered with an additional layer of the precious metal to enhance the conductivity of the connection with a conductor of a jack. The selected portions normally include the rounded surfaces 74, 76 because they are exposed surfaces and are normally engaged by an aligned jack conductor, the exposed flat push surface 58 (defined by the first and second push surfaces 64, 68) between the rounded surfaces 74, 76, and a relatively small portion of each flat side surface 78 of the contact 16.

Cost savings may be realized by reducing the areas of a contact which are covered with a precious metal. However, such cost savings are preferable if they can be accomplished without sacrificing performance or affecting the manufacturability of the contacts. The contact design of the present disclosure provides for such cost savings without limiting performance and without affecting manufacturing processes, whether the processes relate to the manufacturing of the contacts themselves or to the insertion of the contacts into the plug housings 24. The contact design of the present disclosure provides the ability to use conventional metal plating techniques and conventional insertion techniques utilizing existing apparatuses such as the actuated ram 42 discussed above.

The notch 60 reduces the size of the engagement surface 56 that is normally covered with the additional precious metal, leading to cost savings. Since the apparatus used for the plating of the precious metal normally includes a roller type structure that engages only the uppermost surfaces of the contact 16, the area cut out by the notch 60 does not get plated by the precious metal. The cost savings associated with the notch 60 thus directly correspond to the length $L_N$ of the notch 60 extending between the front and rear vertical walls 70, 72 defining the notch 60. Also, there are cost savings associated with the amount of precious metal material that otherwise would have extended to the flat side surfaces of the contact 16 eliminated by the notch 60.

As noted above, according to an example embodiment, the contact 16 is designed such that the notch 60 starts at a point that is at least half way from the front end 48 of the contact 16. This configuration provides an engagement surface 56 for engaging a jack conductor that has a length $L_E$ of at least 50% of the full length $L_C$ of the contact 16 from the front end 48 to the rear end 50 of the contact 16. The 50% engagement length is a desired length in most modular plug connectivity applications. According to one example embodiment, the contact 16 may define a length $L_C$ between the front and rear ends 48, 50 of the contact 16 of about 0.1370 inches, wherein the notch 60 may start at about 0.0685 inches from the front end 48 of the contact 16.

Additionally, as noted above, the contact 16 of the present disclosure is designed such that the notch 60 defines ends provided by vertical walls at both the front 80 and the rear 82 of the notch 60. The front 80 of the notch 60 is defined by the first vertical wall 70 and the rear 82 of the notch 60 is defined by the second vertical wall 72. The contact 16 is designed such that the second vertical wall 72 is spaced from the rear end 50 of the contact 16, providing the second engagement surface 66. And as noted above, the second engagement surface 66 defines the second push surface 68 that is at the same vertical height as the first push surface 64 of the first engagement surface 62. This configuration provides the contact 16 with push regions both adjacent the front 48 of the contact 16 (i.e., the first push surface 64) and adjacent the rear 50 of the contact 16 (i.e., the second push surface 68) for use with a conventional ram-type apparatus 42 in inserting the contact 16 into a plug housing 24. Without a second push surface 68 that is at the same vertical height as the first push surface 64, a ram that is normally used to insert such contacts would have to be modified to accommodate for a lack of a push region adjacent the rear of the contact.

According to certain other embodiments, the locating hole 54 of the contact 16 may be provided slightly offset toward the front 48 of the contact 16. This would provide further material between the notch 60 and the locating hole 54 and also can act as a keying feature during the stamping process for orienting the front and rear ends 48, 50 of the contact 16 for positioning the desired notch 60.

Although in the foregoing description, terms such as "top," "bottom," "upper," "lower," "front," "back," "rear," "right," and "left," might be have been used for ease of description and illustration, no restriction is intended by such use of the terms. The devices described herein can be used in any orientation.

Having described the preferred aspects and embodiments of the present disclosure, modifications and equivalents of the disclosed concepts may readily occur to one skilled in the art. However, it is intended that such modifications and equivalents be included within the scope of the claims which are appended hereto.

What is claimed is:

1. A metallic contact configured for insertion into a modular telecommunications plug, the contact comprising:

a generally planar body defining a top end, a bottom end, a front end, a rear end, and a length extending from the front end to the rear end, wherein the bottom end is at least partially defined by a blade for piercing an insulation of a wire positioned within the plug and at least a portion of the top end is configured to electrically contact a conductor of a jack that receives the modular telecommunications plug;

the top end defined at least in part by a first engagement surface that is separated from a second engagement surface by a notch that is provided at a non-central, offset position in a front to rear direction, wherein an uppermost portion of the first engagement surface defines a first push surface that is generally at the same height as a second push surface defined by an uppermost portion of the second engagement surface;

the notch defined by a front vertical wall spaced from a rear vertical wall and the first and second push surfaces being generally flat surfaces perpendicular to the front and rear vertical walls of the notch, wherein the first engagement surface is closer to the front termination end than the second engagement surface and wherein the second engagement surface is closer to the rear cable receiving end than the first engagement surface, wherein the first engagement surface is at least one and a half times longer than the second engagement surface.

2. The contact of claim 1, further comprising at least two blades for piercing the insulation of a wire positioned within the plug.

3. The contact of claim 1, wherein at least a portion of the first engagement surface defines a rounded portion transitioning from the front end of the contact to the first push surface.

4. The contact of claim 3, wherein at least a portion of the second engagement surface defines a rounded portion transitioning from the rear end of the contact to the second push surface.

5. The contact of claim 1, wherein the front vertical wall defining the notch is positioned at a distance of at least half the length of the contact from the front end of the contact.

6. The contact of claim 1, wherein the notch is generally square-shaped.

7. A modular telecommunications plug for connection to a jack, the modular telecommunications plug comprising:

a housing defining a latch for snap-fit engagement with the jack, the housing further defining a front termination end and a rear cable receiving end, the front termination end configured to house a plurality of wires of a telecommunications cable to be inserted into the housing from the rear cable receiving end along a cable insertion direction, the front termination end also including a plurality of contacts configured to engage the plurality of wires in a direction generally perpendicular to the cable insertion direction;

each of the contacts comprising:

a generally planar body defining a top end, a bottom end, a front end, a rear end, and a length extending from the front end to the rear end, wherein the bottom end is at least partially defined by a blade for piercing an insulation of a wire positioned within the plug and at least a portion of the top end is configured to electrically contact a conductor of a jack that receives the modular telecommunications plug;

the top end defined at least in part by a first engagement surface that is separated from a second engagement surface by a notch that is provided at a non-central, offset position in a front to rear direction, wherein an uppermost portion of the first engagement surface defines a first push surface that is generally at the same height as a second push surface defined by an uppermost portion of the second engagement surface;

the notch defined by a front vertical wall spaced from a rear vertical wall and the first and second push surfaces being generally flat surfaces perpendicular to the front and rear vertical walls of the notch, wherein the first engagement surface is closer to the front termination end than the second engagement surface and wherein the second engagement surface is closer to the rear cable receiving end than the first engagement surface, wherein the first engagement surface is at least one and a half times longer than the second engagement surface.

8. The modular telecommunications plug of claim 7, wherein the plug is a registered jack type modular plug.

9. The modular telecommunications plug of claim 7, wherein each contact includes at least two blades for piercing the insulation of a wire positioned within the plug.

10. The modular telecommunications plug of claim 7, wherein at least a portion of the first engagement surface defines a rounded portion transitioning from the front end of the contact to the first push surface.

11. The modular telecommunications plug of claim 10, wherein at least a portion of the second engagement surface defines a rounded portion transitioning from the rear end of the contact to the second push surface.

12. The modular telecommunications plug of claim 7, wherein the front vertical wall defining the notch is positioned at a distance of at least half the length of the contact from the front end of the contact.

13. The modular telecommunications plug of claim 7, wherein the notch is generally square-shaped.

14. A telecommunications cable assembly comprising:

a modular telecommunications plug for connection to a jack, the modular telecommunications plug comprising a housing defining a latch for snap-fit engagement with the jack;

a telecommunications cable defining a cable jacket surrounding a plurality of insulated wires coupled to the housing, wherein a plurality of contacts of the modular telecommunications plug engage the wires of the telecommunications cable coupled to the housing;

each of the contacts comprising:

a generally planar body defining a top end, a bottom end, a front end, a rear end, and a length extending from the front end to the rear end, wherein the bottom end is at least partially defined by a blade for piercing an insulation of a wire coupled to the plug and at least a portion of the top end is configured to electrically contact a conductor of a jack that receives the modular telecommunications plug;

the top end defined at least in part by a first engagement surface that is separated from a second engagement surface by a notch that is provided at a non-central, offset position in a front to rear direction, wherein an uppermost portion of the first engagement surface defines a first push surface that is generally at the same height as a second push surface defined by an uppermost portion of the second engagement surface;

the notch defined by a front vertical wall spaced from a rear vertical wall and the first and second push surfaces being generally flat surfaces perpendicular to the front and rear vertical walls of the notch, wherein the first engagement surface is closer to the front termination end than the second engagement surface and wherein the second engagement surface is closer to the rear cable receiving end than the first engagement surface, wherein the first engagement surface is at least one and a half times longer than the second engagement surface.

* * * * *